United States Patent [19]

Cook et al.

[11] Patent Number: 4,770,154

[45] Date of Patent: Sep. 13, 1988

[54] MOMENT TRANSFER PULLEY SYSTEM FOR COMPOUND ARCHERY BOWS

[76] Inventors: Gerald L. Cook, P.O. Box 4, Fort Benton, Mont. 59442; James C. Daniel, 3812 S. Hudson St., Seattle, Wash. 98118

[21] Appl. No.: 913,697

[22] Filed: Sep. 30, 1986

[51] Int. Cl.[4] ..... F41B 5/00

[52] U.S. Cl. ..... 124/23 R; 124/DIG. 1

[58] Field of Search ..... 124/23 R, 24 R, DIG. 1

[56] References Cited

U.S. PATENT DOCUMENTS

| | | | |
|---|---|---|---|
| 4,060,066 | 11/1977 | Kudlacek | 124/23 R |
| 4,078,537 | 3/1978 | Carella | 124/24 R |
| 4,660,536 | 4/1987 | McPherson | 124/24 R |

*Primary Examiner*—Richard C. Pinkham

*Assistant Examiner*—Benjamin Layno

*Attorney, Agent, or Firm*—Graybeal, Jensen & Puntigam

[57] ABSTRACT

A compound bow (20) with a moment transfer pulley system (28) for reducing the holding force at the maximum bowstring draw position and for attaining and maintaining a high amount of stored energy. The moment transfer pulley system includes a pulley assembly (38) having a primary axle hole (76) and a primary axle (44) upon which the pulley assembly rotates. A secondary axle (64) is mounted to the pulley assembly. Mounted on the bow limb tip (24) on opposite sides of the pulley assembly are two moment transfer cams (52 and 54). These transfer cams are held in fixed relationship to the limb 24. The transfer cams include a notch (78) for receiving the secondary axle (64). As the bow reaches the full draw position the secondary axle (64) is received into the notches (78).

26 Claims, 6 Drawing Sheets

MOMENT TRANSFER PULLEY SYSTEM FOR COMPOUND ARCHERY BOWS

BACKGROUND OF THE INVENTION (1) Field of the Invention

The present invention pertains to the field of compound archery bows. More particularly, it relates to the eccentrically mounted pulleys or wheels, also known as "cams", which are positioned at the end of the archery bow limbs and/or the bow riser or a combination thereof. The present invention is designed, like the prior art systems, to reduce the holding force at the maximum bowstring draw position, but the present invention differs from the prior systems in the following respects: by attaining and maintaining a high amount of stored energy; by increasing the "letoff" greater than any prior art system; and by offering variable or adjustable draw length with a precise stop at the full draw position. "Letoff" is defined as the amount of the reduction of the holding force exerted by the archer at the fully drawn position. Specifically, the present invention accomplishes four main advantages not accomplished by the prior art systems: (a) it achieves as high as 90% of the theoretical maximum stored energy; (b) it achieves adjustable letoff of 90% or greater instantaneously at the point of full draw; (c) it achieves variable or adjustable draw length to fit the entire range of users; and, (d) it provides for a precise full draw position set for each individual user.

(2) Description of the Prior Art

Since the advent of the compound archery bow exemplified by the Allen bow disclosed in Allen U.S. Pat. No. 3,486,495 issued Dec. 30, 1969 there has been an increasing adoption and use of the compound bow by thousands of archery enthusiasts.

The following patents illustrate eccentric pulley systems that are considered to be the state of the art prior to the present invention:

Rickard U.S. Pat. No. 4,203,412 issued May 20, 1980 represents the best of the prior art for achieving maximum letoff with minimal loss of potential energy in the last 10% of the draw force curve. The disadvantages of this system are that: it uses a complex trigger release mechanism; it does not incorporate many of the desirable features found in the more traditional compound bow; and while exhibiting less potential stored energy loss over the final portion of the draw better than any other available system it still loses 50% of the potential energy possible over the last several inches of the draw force curve.

Simonds et al U.S. Pat. No. 4,461,267 issued July 24, 1984 and Miller U.S. Pat. 4,519,374 issued May 28, 1985 represent the best of the prior art for maximizing stored energy as represented by the area under their draw force curves. The disadvantages of these systems are that: they are only storing 80% of the maximum potential energy available; they are locked into a low letoff configuration which make them uncomfortable to hold at full draw; they do not have a precise point at which the user comes to full draw; they require additional components to alter draw length; and, in the case of the Simonds et al system, it represent a complex mechanical system which is not acceptable to many users.

Jarrett U.S. Pat. No. 4,512,326 issued Apr. 23, 1985 represents another system which seeks maximum letoff as a primary consideration. The disadvantages of this system are that: it loses potential energy in the front end of the draw force curve; it loses potential energy approaching the full draw position as in the Rickard system; it does not provide for adjustability of the draw length to fit individual users; and, the combination of the stiff limb/flexible limb gives it an appearance which is not readily acceptable to the general user.

Jennings U.S. Pat. No. 4,562,824 issued Jan. 7, 1986 represents a state-of-the-art system for altering draw length with minimal tools, without dismantling the bow, and without changing the bow peak draw weight. The disadvantages of the system are: a complex mechanical system is employed; draw length adjustment is available only in predetermined increments; additional pieces are required; the system does not provide for a precise maximum draw length point; and, the appearance of the system is unusual which leads to consumer reluctance.

In contrast to the foregoing prior art systems, the present invention provides an improved eccentric compound pulley system, which we have named the "moment transfer pulley system", which retains all of the traditional advantages of a compound bow, but which will also store a greater amount of potential energy in the limbs while decreasing the force necessary to hold the bow at full draw by a greater amount than any prior art system. The release of this higher amount of stored energy results in a faster arrow and a steadier arrow due to the maximum uniform force which is imparted to the arrow.

A further advantage of the moment transfer pulley system is that it provides a variable or adjustable draw length to fit individual users and it provides a precise full draw length stop point to fit each individual user.

SUMMARY OF THE INVENTION

The invention is a modular pulley assembly system which, when mounted on a compound bow, allows that bow to attain the maximum amount of stored energy, the draw force curve approaching the configuration of a rectangle, as illustrated by FIG. 2.

Secondly, unlike any prior art system, the present invention provides an adjustable letoff of 90% or greater, instantaneously at full draw, while losing no stored energy as the user approaches full draw as illustrated in FIG. 2.

Thirdly, the draw length of the bow is adjustable to fit all users without dismantling the bow and without the use of any tool other than an Allen wrench and without significantly altering the draw force curve or letoff % for users at different draw lengths.

Fourthly, unlike any prior art system, the present system provides for a precise adjustable full draw length stop position.

The present invention incorporates all of the foregoing desirable features into one simple, safe, and reliable system which, based on performance and appearance, will be readily acceptable to the majority of users.

The design features which we have incorporated into the present system give a smooth rapid rise in the early portion of the draw force curve (the solid line in FIG. 2) which reaches a plateau that is maintained until the full draw point is reached and a vertical drop at this point to an adjustable minimum level. In achieving this nearly-rectangular configuration, the only sacrifice we are making in stored energy comes in the early part of the draw and this is done to ensure a smooth draw. In addition to the smooth early draw, the maximum stored energy, and the maximum letoff features, we have achieved a draw length adjustment feature not found in any other system. We have combined an incremental draw length adjustment feature and a moment transfer system which provides for a precise full draw point. Furthermore, this draw length adjustment feature in combination with the improved draw force curve makes one pulley system adaptable to fit the entire range of users without sacrificing performance.

Several additional advantages we have found in using the moment transfer pulley system on bows are: (a) the present invention provides a reduced tendency to jump from the user's hand upon release of the drawstring; (b) noise and energy vibrations to and throughout the bow components are reduced because the cables travel over consistent radii at uniform forces producing a draw and release that is exceptionally smooth and quiet; (c) the moment transfer pulley system does not impart a lateral cast on the arrow upon release, thereby producing truer arrow flight and a more efficient selection of the arrow spline on the arrow shaft that produces improved accuracy; and (d) the bow has substantially no net torsional moment imbalance at full draw, so that the useful life of the bow is increased and accuracy is more assured upon release of the bowstring.

Another advantage that will be of great interest to archers is that the present invention can be retrofitted to nearly any compound bow made since 1969. This provides an economical means by which the archer can greatly improve the performance of his existing equipment.

Finally, the paramount factor recognized in evaluating the performance of a bow is the speed of the arrow and this is a direct function of the amount of energy stored in the bow during its draw to the fully drawn position. The amount of stored energy may be determined by calculating the total area under the draw force curve. The bow which has the capability of storing the greatest amount of energy is the one wherein the curve has an initial slope approaching a vertical line and which then holds the maximum force until full draw length is reached. However, in practice, many popular compound bows have exhibited draw force curves wherein the initial slope leading to the maximum is relatively low and the force peaks at around mid-draw length and then falls off to about 50% over the remainder of the draw. Furthermore, the letoff should not reduce the stored energy, as all prior art systems do.

In the present invention, the moment transfer pulley system (consisting of the pulley assembly and related components) is constructed so that it yields a draw force curve having a steep initial slope, a smooth transition to a flat plateau at maximum force and then it maintains this until the full draw length is reached, whereupon a vertical downslope occurs. The present system loses no potential stored energy, except in the initial part of the curve where force is intentionally reduced to ensure smooth draw. Furthermore, the percentage of letoff is increased to a point that far exceeds any prior art system.

Among the benefits achieved are: a flatter arrow trajectory and therefore less critical distance judgment; greater kinetic energy imparted to the arrow and therefore greater velocity; a shorter time of flight and less time for external forces, such as prevailing winds and target movement, to cause deviations from the intended flight path or point of impact; less noise from the bow components; a simple draw length adjustment feature that is convenient for the archer and allows for an inventory reduction by the dealer; and the moment transfer pulley system provides for a precise full draw length stop point which greatly improves consistency and accuracy from shot to shot.

DESCRIPTION OF THE PREFERRED EMBODIMENTS

The Moment Transfer Pulley System

Figure 2:
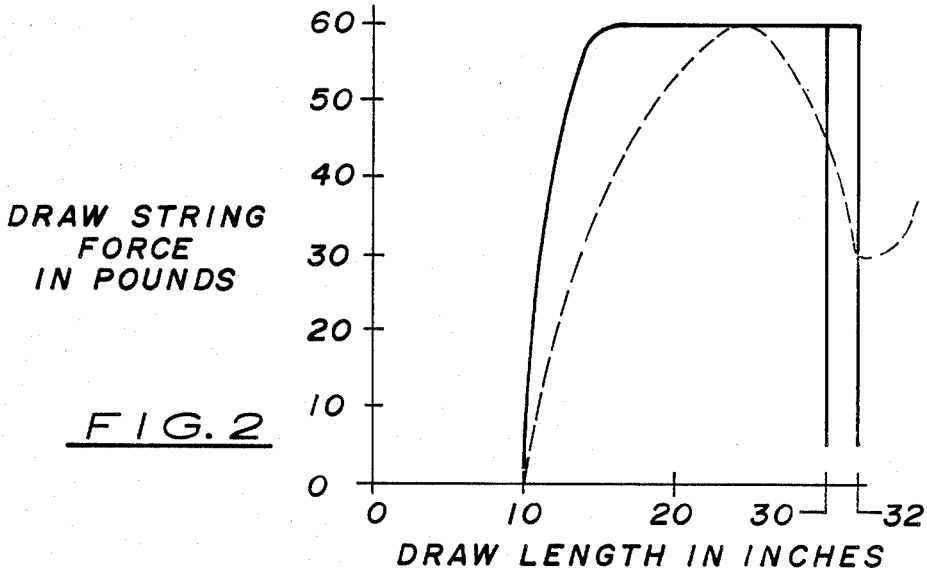
FIG. 2 is a draw force graph wherein the solid lines are the curves generated by either the first or second embodiment of the moment transfer pulley system at two draw length settings (30 inches and 32 inches, respectively) and wherein the dashed line is the draw force curve generated by a typical prior art compound bow having a draw length of 32 inches.

The components of the moment transfer pulley system are: first, a specially profiled compound pulley assembly that will achieve the nearly-rectangular draw force curve shown in FIG. 2. There are two embodiments of the compound pulley assembly that can achieve this. First, there is an external profiled compound pulley assembly which is the first embodiment described below and shown in FIGS. 3–7; and second there is an internal profiled compound pulley assembly which is the second embodiment described below and shown in FIGS. 8–12.

The second component of the moment transfer pulley system is a secondary axle which is mounted transversely to the plane of the compound pulley assembly and projects orthogonally from each side thereof. The location of the secondary axle is selected so that when the archer reaches full draw, the projecting ends of the secondary axle will be received into the notches located in the moment transfer cams. The secondary axle is a critical component of the present invention and it functions as a cam follower in cooperation with the moment transfer cams to achieve a transfer of the force holding point of the pulley assembly from the primary axle to the secondary axle, thereby transferring the rotation moment arm from the primary axle to the secondary axle and thereby obtaining the high percentage letoff.

The third component of the moment transfer pulley system is a pair of moment transfer cams. Each moment transfer cam is a fan-shaped wedge of flat stock, preferably made of steel or other suitable metal, having a curved (convex) outer edge that has a small U-shaped receiving notch to receive the secondary axle. The action of the secondary axle resting on the flat surface of the shoulder of the notch in the moment transfer cam and the reduction of the bowstring holding force produces a redistribution of reacting vector forces. The end result of this redistribution of reacting vector forces is that the primary reacting vector is now acting on the limb through the secondary axle and the reacting vector force represented by the bowstring is greatly reduced. The angle between the plane of the limb cable and the plane of the side of the receiving notch in the moment transfer cam controls how much or how little the letoff will be. Changing the pitch of the side of the receiving notch will change the amount of letoff correspondingly from as high as 100%, which is not operable, to as low as 30%. Naturally, the higher the letoff the better it is to reduce muscle tension experienced by the user, and this must happen without any loss of the stored energy. At 100% letoff, a condition is obtained where the bow will simply not release its stored energy. Anything less than 100% letoff is operable and will allow the secondary axle, under the principle of a cylinder rolling on an inclined plane, to move out of the receiving notch and then instantly release all of the stored energy against the nock of the arrow.

The present invention, as exemplified by the first and second embodiments, has a defined geometrical relationship by which moment transfer will mechanically occur, that is, force will be transferred to or from a primary axle via one vector to or from a secondary axle via a second vector. This principle of moment transfer allows a vector distribution to be obtained whereby the archer will experience a high letoff percentage thereby creating a situation where only a few pounds of force, for example, four to twelve pounds of force depending upon the bow's draw weight, are needed to keep the bow at full draw. The amount of force needed to keep the bow at full draw is determined by the angle between the plane of the limb cable and the plane of the side of the receiving notch in the moment transfer cam.

This is true in both the external profiled pulley assembly, illustrated by the first embodiment of the invention, and it is also true in the internal profiled pulley assembly illustrated by the second embodiment. Even though each embodiment achieves its energy storage in different ways, due to mechanical and configurational differences, the energy storage curve in FIG. 2 is identical for both embodiments of the moment transfer pulley system.

The First Embodiment

Figure 1:
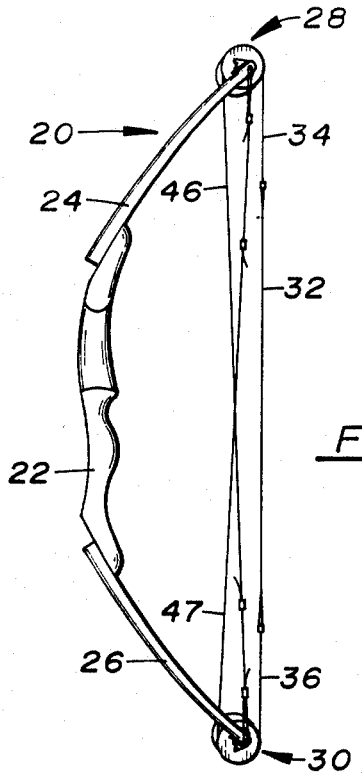
FIG. 1 is a side elevation view of a right-handed compound bow using the first embodiment of the moment transfer pulley system as viewed from the left side of the bow.

Referring to the drawings, FIG. 1 shows an improved archery bow 20 of the present invention consisting of a conventional riser or handle 22, a conventional upper limb 24 and a conventional lower limb 26, an upper moment transfer pulley system 28 and a lower moment transfer pulley system 30, a conventional bowstring 32 connected to the upper bowstring cable 34 and to the lower bowstring cable 36, and an upper limb cable 46 and a lower limb cable 47.

Figure 20:
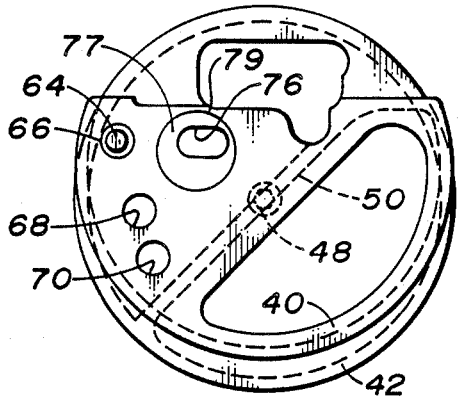
FIG. 20 is a side elevation view of the upper pulley assembly of the first embodiment of the moment transfer pulley system as viewed from the right side.

The upper moment transfer pulley system 28 and the lower moment transfer pulley system 30 are mirror images of each other. The upper moment transfer pulley system 28 will be described in detail, it being understood that the lower moment transfer pulley system 30 is the mirror image thereof. Referring to FIGS. 3–7 and FIG. 20, the upper moment transfer pulley system 28 comprises an eccentrically positioned cable mounting pulley assembly 38 consisting of a grooved limb cable wheel 40 and a grooved bowstring cable wheel 42 with wheel centers which are offset from each other. The two wheels 40 and 42 are joined together so that they eccentrically rotate as a unit on a transverse primary axle 44 and they are made of aluminum alloy or other sufficiently rigid material. There is a transverse oblong opening 76 as shown in FIG. 20 passing through the insert 77 for receiving primary axle 44. The insert 77 is made of nylon or other similar material and is press fitted into a cylindrical hole 79 which passes transversely through both wheels. The profile of the wheels 40 and 42 is designed in relation to the limb tensile strength, to the primary axle 44, and to each other in order to achieve a nearly-rectangular draw force curve (FIG. 2) while maintaining a smooth draw from zero to maximum draw force.

Limb cable 46 passes partially around limb cable wheel 40 and then goes through a passageway 50 in pulley assembly 38. The cable emerges from passageway 50, then passes partially around bowstring cable wheel 42 and becomes bowstring cable 34.

Set screw 48 is positioned transversely to the cable passageway 50 to provide for variable cable length (draw length) adjustment and for securing the cable 46 in a fixed position when the desired setting is attained.

Figure 6:
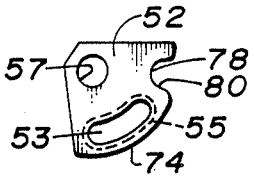
FIG. 6 is a side elevation view of a moment transfer cam in isolation.

Two moment transfer cams 52 and 54 (both cams are visible in FIG. 7) are made of steel or other suitable material and are mounted on primary axle 44 and held in fixed relationship to limb branches 24*a* and 24*b* (FIG. 7) by two threaded shoulder bolts 60 and 62 which are tightened against internally-threaded mounting blocks 56 and 58 by inserting an Allen wrench in hexagonal sockets 61 and 63. Mounting blocks 56 and 58 are adhesively mounted on limb branches 24*a* and 24*b*, respectively. As shown in FIG. 6, each moment transfer cam has a circular hole 57 for primary axle 44 and an arcuate slot 53 near the outer edge 74. The side of each moment transfer cam that faces the pulley assembly has a recess 55 in the slot 53 for receiving the head of the shoulder bolt so that the head will be flush with the surface of the moment transfer cam. The arcuate slot 53 provides adjustability for the angle between the plane of the side 80 of the receiving notch 78 and the plane of the limb cable 46. This provides an adjustable amount of letoff.

Figure 7:
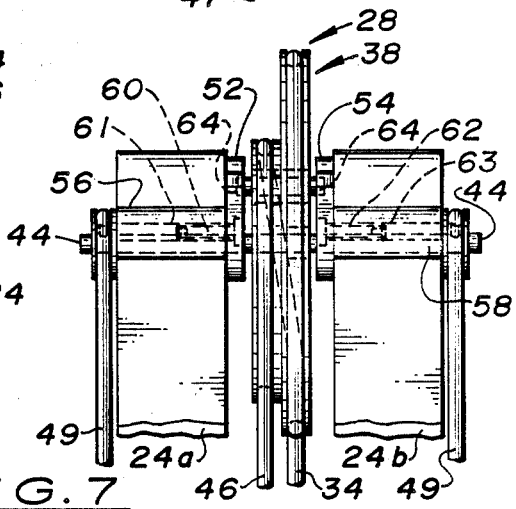
FIG. 7 is a front view taken along line 7—7 in FIG. 3 of the upper moment transfer pulley system and the upper limb in the rest position.

Primary axle 44 is a rod made of steel or other suitable material on which pulley assembly 38 rotates as bowstring 32 is drawn. As shown in FIG. 7, the harness 49 for lower limb cable 47 is looped around the ends of primary axle 44.

Secondary axle 64, made of steel or other suitable material, is mounted transversely in pulley assembly 38. Secondary axle 64 is removable and is held in a nylon bushing 66 by a snap-ring (not shown) which is transverse to the axis of the secondary axle 66. The nylon bushing 66 is in two cylindrical pieces that are press fitted into a cylindrical position hole 65 in the pulley assembly 38. The snap-ring is held between the two pieces of bushing 66. The secondary axle 64 and the bushing 66 can be set in the other position holes 68 and 70 that pass through pulley assembly 38 to provide for incremental draw length adjustment. When the position of secondary axle 64 is changed from one position hole to another, then the insert 77 for receiving primary axle 44 is removed and reinserted with a new orientation of the oblong opening 76 so that the oblong opening points toward the new position of secondary axle 64.

The operation of the upper moment transfer pulley system 28 is as follows. The user experiences a smooth rapid buildup to maximum draw force and a uniform pull at maximum draw force through the remainder of the draw length. Before reaching the maximum rotation or draw length, the secondary axle 64 comes into contact simultaneously with the convex outer edge 74 of the two moment transfer cams 52 and 54 and then follows in contact with convex edge 74 through the remaining draw. The mechanical effect of this contact is that outer edge 74 acts as a cam working surface and secondary axle 64 acts as a cam follower.

Figure 5:
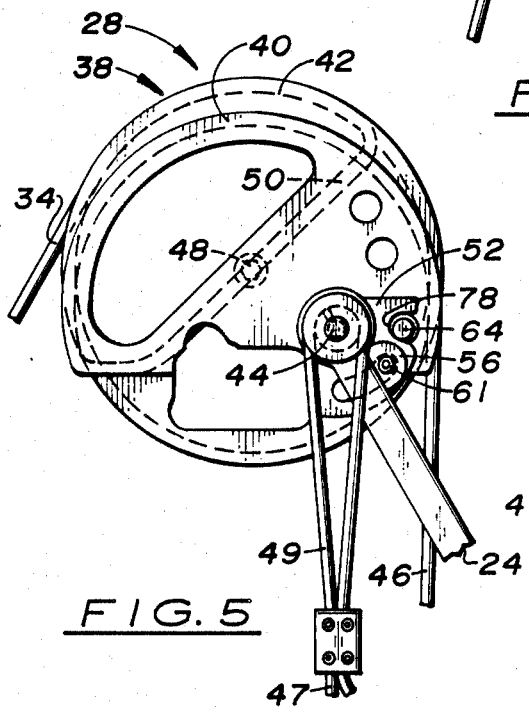
FIG. 5 is a side elevation view of the upper moment transfer pulley system of FIG. 3 and the upper limb, at the fully drawn (moment transferred) position which is a 180° rotation from the rest position.

Upon reaching full draw or 180° rotation (100% of the draw length as shown in FIG. 5), secondary axle 64 has moved into receiving notch 78 (the moment transferred position) in each of the two moment transfer cams 52 and 54, respectively. When secondary axle 64 moves into U-shaped receiving notch 78, pulley assembly 38 displaces to the left a distance that corresponds to the depth of notch 78. As shown in FIG. 20, primary axle hole 76 is oblong or elongated in shape to allow this lateral displacement of pulley assembly 38 on primary axle 44.

When secondary axle 64 has moved into receiving notch 78, this transfers the force holding point of pulley assembly 38 from primary axle 44 to secondary axle 64, thereby transferring the rotation moment arm from primary axle 44 to secondary axle 64. At full draw, the user relaxes the holding force on the bowstring 32 to a few pounds of force as shown in FIG. 2. Upon release of bowstring 32, secondary axle 64 rolls out of notch 78 in each of the two moment transfer cams 52 and 54 and instantaneously maximum force is acting on the arrow. The force acting on the arrow on release follows the same curve as illustrated in FIG. 2 but in the reverse direction.

The actual stored energy (the area under the draw force curve in FIG. 2) and the theoretical stored energy are calculated and compared for the moment transfer pulley system at a 30-inch draw as follows:

60 lbs. of force×20 inches of draw=1200 inch-lbs. (theoretical maximum stored energy).

(30 lbs.×4 inches)+(60 lbs.×16 inches)=1080 inch-lbs. (actual stored energy (FIG. 2) in bow using the moment transfer pulley system).

(1080 inch-lbs. divided by 1200 inch-lbs.)×100%=90% of theoretical maximum stored energy.

Figure 3:
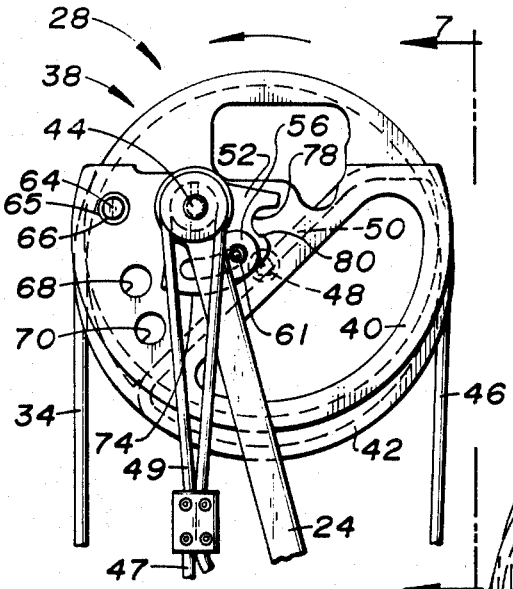
FIG. 3 is a side elevation view of the upper moment transfer pulley system of the first embodiment of the invention and the upper limb of the bow in the rest position, as viewed from the right side of the right-handed bow of FIG. 1.
Figure 13:
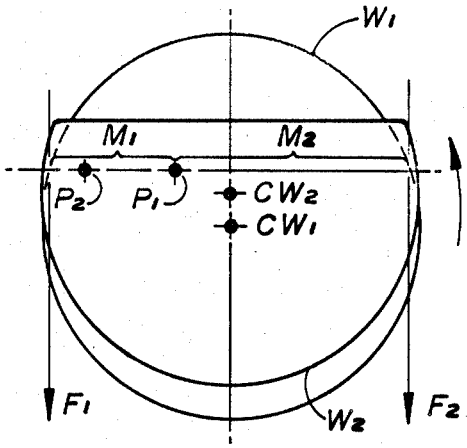
FIG. 13 is a schematic diagram based on the first embodiment of the invention in the rest position as shown in FIG. 3.

FIG. 13 is a schematic diagram based on the first embodiment 28 of the moment transfer pulley system, in the rest position as shown in FIG. 3. In FIG. 13, $P_1$ is the center point of the primary axle 44; $P_2$ is the center point of the secondary axle 64; $W_1$ is bowstring cable wheel 42; $W_2$ is limb cable wheel 40; $CW_1$ is the center point of $W_1$; $CW_2$ is the center point of $W_2$; $F_1$ is the bowstring cable force; $F_2$ is the limb cable force; $M_1$ is the length of the moment arm of the bowstring cable force $F_1$; and $M_2$ is the length of the moment arm of the limb cable force $F_2$. The moment of $F_1$ is the product of $F_1 \times M_1$. The moment of $F_2$ is the product of $F_2 \times M_2$. At all times, $F_1 \times M_1 = F_2 \times M_2$.

Figure 4:
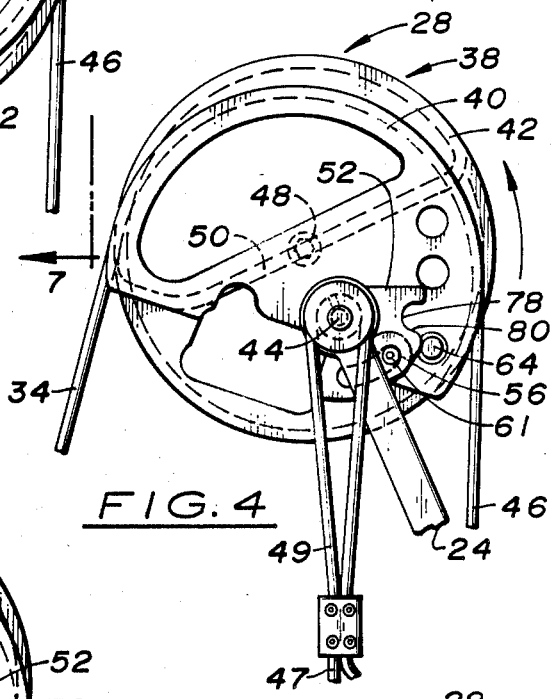
FIG. 4 is a side elevation view of the upper moment transfer pulley system of FIG. 3 and the upper limb, at the 90% drawn position.
Figure 14:
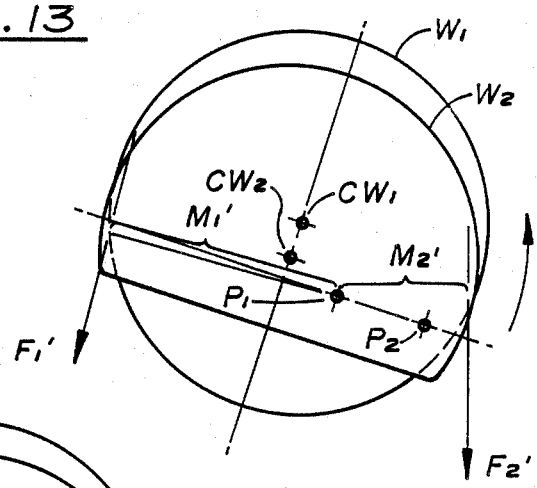
FIG. 14 is a schematic diagram based on the first embodiment of the invention in the 90% drawn position as shown in FIG. 4.

FIG. 14 is a schematic diagram based on the first embodiment 28 in the 90% drawn position as shown in FIG. 4. $F_1'$ is the bowstring cable force in this position; $F_2'$ is the limb cable force in this position; $M_1'$ is the length of the moment arm of $F_1'$; and $M_2'$ is the length of the moment arm of $F_2'$.

Figure 15:
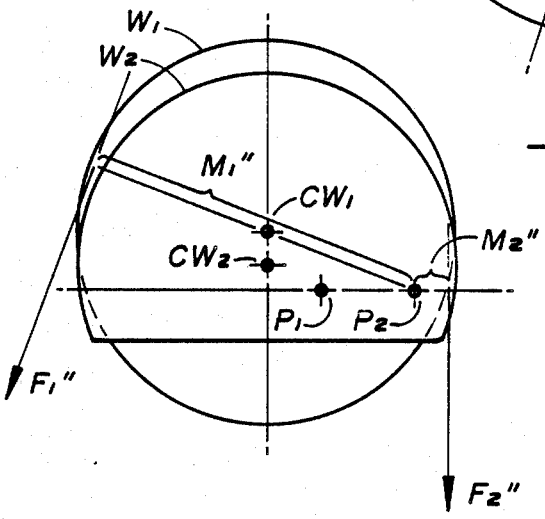
FIG. 15 is a schematic diagram based on the first embodiment of the invention in the full draw position as shown in FIG. 5.

FIG. 15 is a schematic based on the full draw position shown in FIG. 5. $F_1''$ is the bowstring cable force in this position; $F_2''$ is the limb cable force; $M_1''$ is the length of the moment arm of $F_1''$; and $M_2''$ is the length of the moment arm of $F_2''$. It should be noted that the fulcrum or the axis of the moment arms has transferred from $P_1$ to $P_2$ and that $M_1''$ is long compared to $M_2''$.

The preferred version of the first embodiment of the invention is designed in accordance with the following ground rules. First, we chose a circular profile for the perimeters of $W_1$ and $W_2$ in order to achieve a smooth and consistent force acting on the arrow and to avoid sharp breaks in the draw force curve (FIG. 2).

Second, we maximize $F_1$ as soon as possible in the draw stroke and then we maintain that maximum throughout the draw stroke by using the moment transfer system.

Third, we locate $P_2$ as close as possible to the outer perimeter of $W_2$. We place the secondary axle 64 in a location where it passes through both $W_1$ and $W_2$ to provide material strength to hold the forces acting on it.

Fourth, for the longest draw length setting of $P_2$, the line through $CW_1$ and $CW_2$ is perpendicular to the line through $P_1$ and $P_2$ as shown in FIGS. 13–15.

Fifth, as shown in FIG. 13, $P_1$ is located on a line that is at a 45° angle to a horizontal line through $CW_1$. In the preferred version of the first embodiment, a ratio of 2.25 to 1 exists between the radius of $W_1$ and the distance between $CW_1$ and $P_1$. For example, when the radius of $W_1$ is 1.5 inches, the distance between $CW_1$ and $P_1$ is 0.67 inch, and when the radius of $W_1$ is 1.25 inches, the distance between $CW_1$ and $P_1$ is 0.55 inch. Changing the ratio between the radius of $W_1$ and the distance between $CW_1$ and $P_1$ will change the shape of the draw force curve to something less than the optimum.

And sixth, the distance from $P_1$ to the outer edge 74 of moment transfer cam 54 is determined by the location of $P_2$, that is, the secondary axle 64 must be able to move along the outer edge 74 and be received into the receiving notch 78.

We have shown $W_1$ and $W_2$ as having equal radii, but this is not critical. Equal radii are preferred when the bow limbs are of medium strength. If the bow limbs are stiffer, then the radius of limb cable wheel $W_2$ can be made smaller than the radius of bowstring cable wheel $W_1$ in order to increase the force $F_2$ to deflect the stiffer limbs. If the radius of $W_2$ is made smaller, then $M_2$ will decrease and $F_2$ will increase because $F_1 \times M_1 = F_2 \times M_2$.

Tournament archers, children, and women may prefer lighter limbs and a lighter draw. In these situations, equal radii may be satisfactory or the radius of bowstring cable wheel $W_1$ may be made larger than the radius of limb cable wheel $W_2$.

Figure 19:
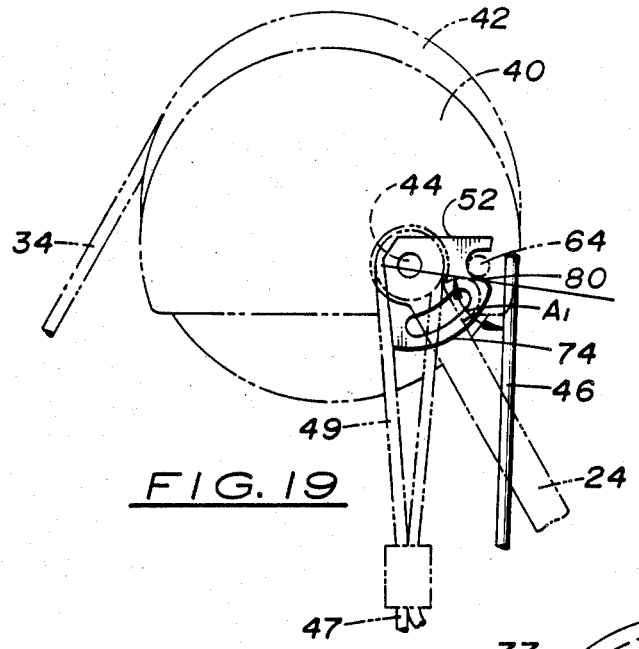
FIG. 19 is a side elevation view partially in phantom of the first embodiment of the invention showing angle $A_1$ which is the angle between the plane of the side of the receiving notch in the moment transfer cam and the plane of the limb cable.

FIG. 19 shows angle $A_1$ which is the angle between the plane of the side 80 of the receiving notch 78 in moment transfer cam 52 and the plane of the limb cable 46. FIG. 19 is based on the first embodiment 28 in the full draw position shown in FIG. 5. At full draw, angle $A_1$ has to approach but be slightly greater than 90°. For example, at the rest position, angle $A_1$ may be about 100°. As full draw approaches, angle $A_1$ decreases to about 95° as the limb 24 is flexed downwardly.

It is contemplated as part of the present invention that a bow can be constructed in which the moment transfer pulley system is mounted on the bow riser instead of at the tips of the limbs. In such a bow, the two ends of the bowstring cable would terminate on a compound pulley assembly mounted on the riser and the limb cables would originate at the riser-mounted compound pulley assembly and they would terminate at harnesses mounted on each limb tip. The moment transfer pulley system in this version will have a transverse primary axle, a transverse secondary axle, and a moment transfer cam mechanism which will function in a manner which is virtually identical to a limb-mounted moment transfer pulley system. The benefit of this version is that it has less mass at the limb tips and therefore it requires less inertial force to set the limb tips in motion and to stop the motion of the limb tips. This results in a faster, smoother energy transfer from the limbs to the arrow.

It is also contemplated that a bow with an inboard bowstring can be constructed in which the bowstring is inboard of the limb cables instead of outboard of the limb cables as shown in FIG. 1. In such a bow, the upper moment transfer pulley assembly rotates clockwise when the bowstring is drawn instead of counterclockwise as shown in FIG. 3. The advantage of the inboard bowstring is that a greater draw length will be achieved and hence there will be more stored energy in the full drawn position.

Figure 21:
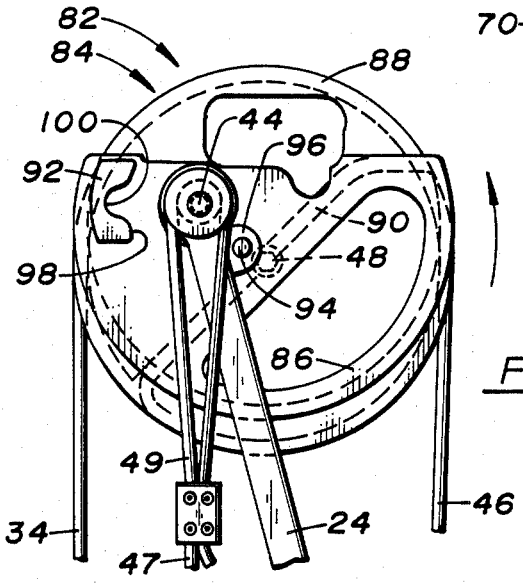
FIG. 21 is a side elevation view of the upper moment transfer pulley system of an alternate version of the first embodiment of the invention and the upper limb of the bow in the rest position as viewed from the right side of a right-handed bow.

An Alternate Version Of The First Embodiment (FIG. 21)

FIG. 21 is a side elevation view of the upper moment transfer pulley system 82 of an alternate version of the first embodiment of the invention and the upper limb 24 of the bow in the rest position as viewed from the right side of a right-handed bow. In this alternate version, the locations of the moment transfer cams and the secondary axle have been changed so that the moment transfer cams are on the wheels and the secondary axles are on the bow limb. The shape of the working surface of the moment transfer cams has also changed from convex to concave.

As in the first embodiment, the upper moment transfer pulley system 82 and the lower moment transfer pulley system are mirror images of each other. The upper moment transfer pulley system 82 will be described in detail, it being understood that the lower moment transfer pulley system (not shown) is the mirror image thereof. Referring to FIG. 21, the upper moment transfer pulley system 82 comprises an eccentrically positioned cable mounting pulley assembly 84 consisting of a grooved limb cable wheel 86 and a grooved bowstring cable wheel 88 with wheel centers which are offset from each other. The two wheels 86 and 88 are joined together so that they eccentrically rotate as a unit on a transverse primary axle 44 and they are made of aluminum alloy or other sufficiently rigid material. There is a transverse oblong opening 76 as shown in FIG. 20 passing through the insert 77 for receiving primary axle 44. The insert 77 is made of nylon or other similar material and is press fit into a cylindrical hole 79 which passes transversely through both wheels. The profile of the wheels 86 and 88 is designed in relation to the limb tensile strength, to the primary axle 44, and to each other in order to achieve a nearly-rectangular draw force curve (FIG. 2) while maintaining a smooth draw from zero to maximum draw force.

Limb cable 46 passes partially around limb cable wheel 86 and then goes through a passageway 90 in pulley assembly 84. The cable emerges from passageway 90 then passes partially around bowstring cable wheel 88 and becomes bowstring cable 34.

Set screw 48 is positioned transversely to the cable passageway 90 to provide for variable cable length (draw length) adjustment and for securing the cable 46 in a fixed position when the desired setting is attained.

Two moment transfer cams 92 are mounted on or cast as a unit with the pulley assembly 84. One moment transfer cam 92 is mounted on the face of the limb cable wheel 86 as shown in FIG. 21. The second moment transfer cam is mounted on the face of the bowstring cable wheel 88 in the same relative location behind the first moment transfer cam but on the opposite side of pulley assembly 84. The second moment transfer cam on the face of the bowstring cable wheel 88 is not visible in FIG. 21.

Primary axle 44 is a rod made of steel or other suitable material on which pulley assembly 84 rotates as the bowstring is drawn. As shown in FIG. 21, the harness 49 for the lower limb cable 47 is looped around the ends of primary axle 44.

Two secondary axles 94 are mounted transversely on the right and left branches of limb 24, respectively. One secondary axle 94 is mounted in a mounting block 96 which in turn is adhesively mounted on the branch of limb 24 as shown in FIG. 21. The second secondary axle is mounted in a similar mounting block in the same relative location on the other branch of limb 24. The second secondary axle is not visible in FIG. 21. Each secondary axle 94 extends from the inner face of its mounting block a short distance in the direction of the pulley assembly 84 so that when the pulley assembly is eccentrically rotated, the secondary axles 94 will make contact simultaneously with the two moment transfer cams 92, the secondary axles 94 acting as cam followers.

The operation of the upper moment transfer pulley system 82 is as follows. The user experiences a smooth rapid buildup to maximum draw force and a uniform pull at maximum draw force through the remainder of the draw length. Upon reaching about 90% of the maximum rotation or draw length, the secondary axles 94 come into contact simultaneously with the concave inner edge 98 of the moment transfer cams 92 and then follow in contact with concave edge 98 through the remaining 10% of the draw. The mechanical effect of this contact is that inner edge 98 acts as a cam working surface and the secondary axles 94 act as cam followers.

Upon reaching full draw or 180° rotation (100% of the draw length), the secondary axles 94 have moved into receiving notch 100 (the moment transferred position). When the secondary axles 94 move receiving notch 100, pulley assembly 84 displaces to the left a distance that corresponds to the depth of notch 100. As shown in FIG. 20, primary axle hole 76 is oblong in shape to allow this lateral displacement of pulley assembly 84.

When secondary axles 94 have moved into receiving notch 100, this transfers the force holding point of pulley assembly 84 from primary axle 44 to secondary axles 94, thereby transferring the rotation moment arm from primary axle 44 to secondary axles 94. At full draw, the user relaxes the holding force on the bowstring to a few pounds of force as shown in FIG. 2. Upon release of the bowstring, secondary axles 94 roll out of notch 100 in moment transfer cams 92 and instantaneously maximum force is acting on the arrow. The force acting on the arrow on release follows the same curve as illustrated in FIG. 2 but in the reverse direction.

The Second Embodiment

Figure 8:
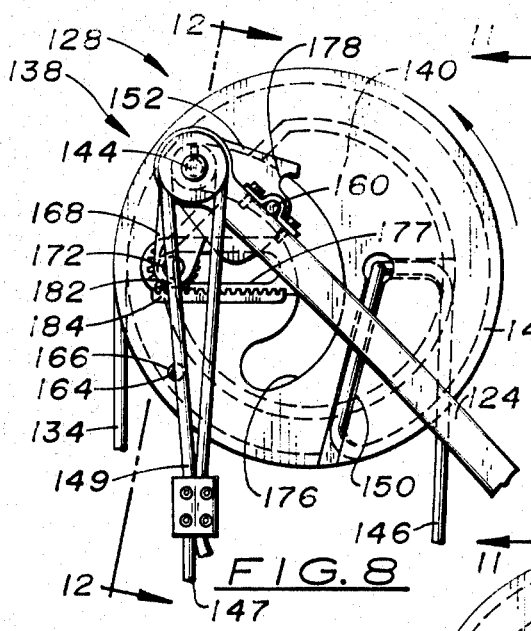
FIG. 8 is a side elevation view of the upper moment transfer pulley system of the second embodiment of the invention and the upper limb of the bow in the rest position as viewed from the right side of a right-handed bow.

FIG. 8 is a side elevation view of the upper moment transfer pulley system 128 of the second embodiment of the invention and the conventional upper limb 124 of the bow in the rest position as viewed from the right side of the right-handed bow.

The second embodiment uses a rack and pinion gear arrangement that is activated by the user pulling on the bowstring. This causes a 180° rotation of the compound pulley assembly 138 and the rack around the pinion gear. As the bowstring is pulled toward its full draw length position, the sleeve receiving the primary axle acts as a cam follower and travels through a slot in the pulley assembly in the shape of a French curve that provides the second embodiment with the same nearly-rectangular draw force shown in FIG. 2 as in the first embodiment.

As in the case of the first embodiment, the upper moment transfer pulley system 128 and the lower moment transfer pulley system (not shown) are mirror images of each other.

The upper moment transfer system 128 comprises an eccentrically positioned cable mounting pulley assembly 138 consisting of a grooved limb cable wheel 140 and a grooved bowstring cable wheel 142 with wheel centers that are concentric. The two wheels are of different radii but they are joined together so that they rotate as a unit on a transverse primary axle 144 and they are made of aluminum alloy or other sufficiently rigid material. There is a transverse slot 176 passing through the wheels for receiving primary axle 144. Slot 176 is in the shape of a French curve as shown in FIG. 8. There is also a second transverse slot 177 passing through the wheels for receiving the transverse axle 172 on which is mounted the pinion gear 182. Slot 177 has a rectangular shape with curved ends as shown in FIG. 8.

Limb cable 146 passes partially around limb cable wheel 140 and then goes through a channel 150 in pulley assembly 138. The cable emerges from channel 150 and then passes partially around bowstring cable wheel 142 and becomes bowstring cable 134.

Two moment transfer cams 152 and 154 (both cams are visible in FIG. 11) are mounted on primary axle 144 and are held in fixed relationship to limb branches **124*a* and 124*b* (FIG. 11) by two connecting pins 160 and 162 which are held by two mounting blocks 156 and 158**.

Figure 11:
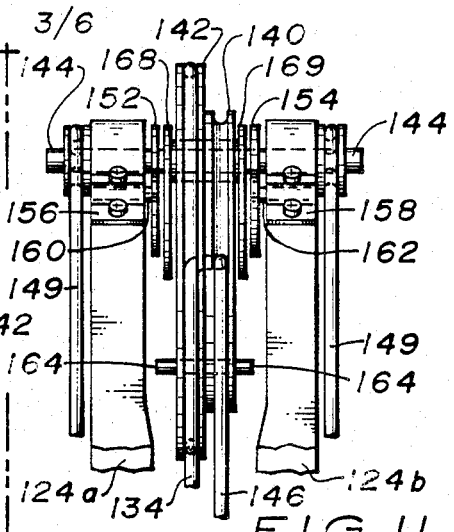
FIG. 11 is a front view taken along line 11—11 in FIG. 8 of the upper moment transfer pulley system and the upper limb in the rest position.

Primary axle 144 is a rod made of steel or other suitable material on which pulley assembly 138 rotates as the bowstring (not shown) is drawn. As shown in FIG. 11, the harness 149 for lower limb cable 147 is looped around the ends of primary axle 144.

Secondary axle 164 is mounted transversely in pulley assembly 138 in position hole 166. As in the first embodiment, secondary axle 164 functions as a cam follower in conjunction with moment transfer cams 152 and 154.

Figure 12:
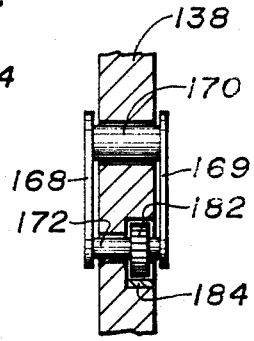
FIG. 12 is a fragmentary sectional view of the second embodiment of the moment transfer pulley system taken along line 12—12 of FIG. 8 with certain elements omitted to simplify the drawing.

Two arms 168 and 169 (both are shown in FIG. 12) hold the transverse sleeve 170 that receives primary axle 144. Arms 168 and 169 also hold the transverse axle 172 on which is mounted pinion gear 182. Pinion gear 182 is preferably made of stainless steel.

Toothed rack 184 is mounted with the teeth pointing upwardly in a recess in the face of bowstring cable wheel 142 below rectangular slot 177 as shown in FIG. 8.

Figure 9:
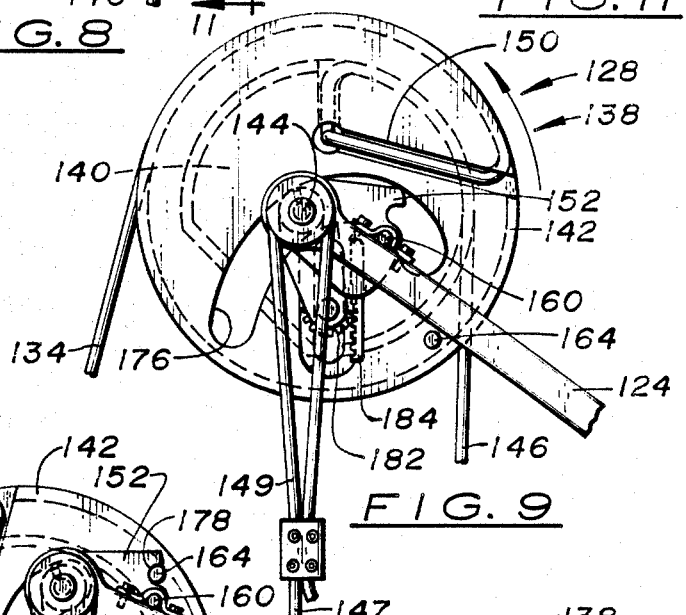
FIG. 9 is a side elevation view of the upper moment transfer pulley system of FIG. 8 and the upper limb at the 50% drawn (90° rotation) position.

The operation of the upper moment transfer pulley system 128 is as follows. The user experiences a smooth rapid buildup to maximum draw force and a uniform pull at maximum draw force through the remainder of the draw length. FIG. 9 is a side elevation view of the moment transfer pulley system 128 and the upper limb 124 at the 50% drawn (90° rotation) position. The rack 184 upon which the pinion gear 182 is traveling has rotated 90° and is now in the vertical position. The primary axle 144 in the sleeve 170 has traveled approximately one-half way along the length of the French curve slot 176.

Upon reaching about 90% of the maximum rotation or draw length, the secondary axe 164 comes into contact with the convex outer edge 174 of the moment transfer cams 152 and 154 and then follows in contact with edge 174 through the remaining 10% of the draw. The mechanical effect of this contact is that outer edge 174 acts as a cam working surface and secondary axle 164 acts as a cam follower.

Figure 10:
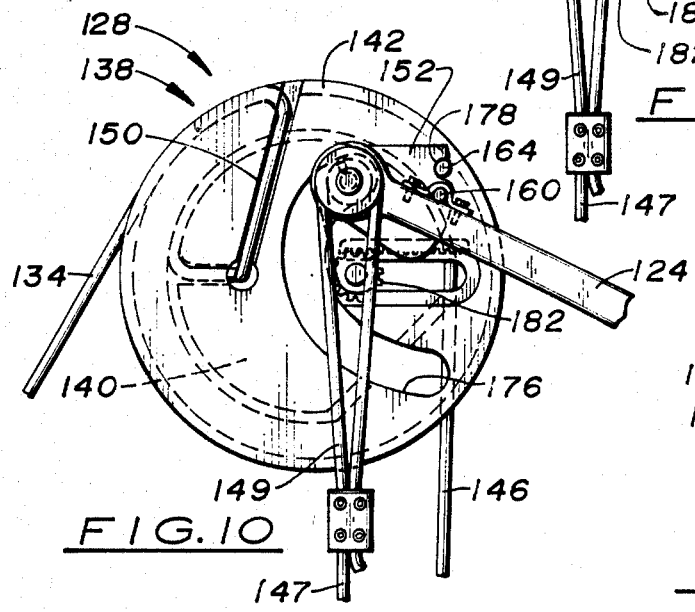
FIG. 10 is a side elevation view of the upper moment transfer pulley system of FIG. 8 and the upper limb at the fully drawn (180° rotation) (moment transferred) position.

FIG. 10 is a side elevation view of the moment transfer pulley system 128 and the upper limb 124 in the fully drawn (180° rotation) position. The rack 184 has now rotated 180° and is in the upside down position. The primary axle 144 in sleeve 170 has now traveled to the end of the French curve slot 176. The secondary axle 164 has rolled into receiving notch 178 (the moment transferred position) in each of the two moment transfer cams 152 and 154, respectively. When secondary axle 164 moves into U-shaped receiving notch 178, pulley assembly 138 displaces to the left a distance that corresponds to the depth of notch 178. The primary axle hole in sleeve 170 is oversized to allow this lateral displacement of pulley assembly 138 on primary axle 144.

When secondary axle 164 has moved into receiving notch 178, this transfers the force holding point of pulley assembly 138 from primary axle 144 to secondary axle 164, thereby transferring the rotation moment arm from primary axle 144 to secondary axle 164. At full draw, the user relaxes the holding force on the bowstring to a few pounds of force as shown in FIG. 2. Upon release of the bowstring, secondary axle 164 rolls out of notch 178 in each of the moment transfer cams 152 and 154 and instantaneously maximum force is acting on the arrow. The force acting on the arrow on release follows the same curve as in FIG. 2 but in the reverse direction.

Figure 16:
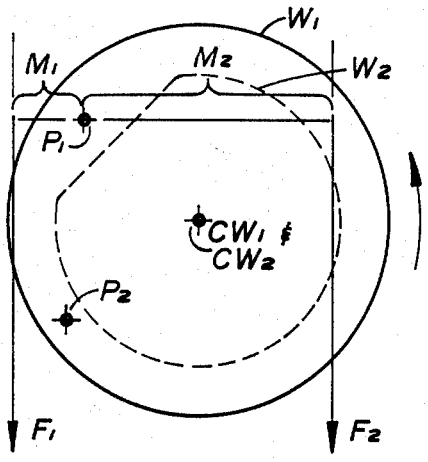
FIG. 16 is a schematic diagram based on the second embodiment of the invention in the rest position as shown in FIG. 8.

FIG. 16 is a schematic diagram based on the second embodiment 128 of the moment transfer pulley system, in the rest position as shown in FIG. 8. In FIG. 16, $P_1$ is the center point of the primary axle 144; $P_2$ is the center point of the secondary axle 164; $W_1$ is bowstring cable wheel 142; $W_2$ is limb cable wheel 140; $CW_1$ is the center point of $W_1$; $CW_2$ is the center point of $W_2$; $F_1$ is the bowstring cable force; $F_2$ is the limb cable force; $M_1$ is the length of the moment arm of the bowstring cable force $F_1$; and $M_2$ is the length of the moment arm of the limb cable force $F_2$. The moment of $F_1$ is the product of $F_1 \times M_1$. The moment of $F_2$ is the product of $F_2 \times M_2$. At all times, $F_1 \times M_1 = F_2 \times M_2$.

Figure 17:
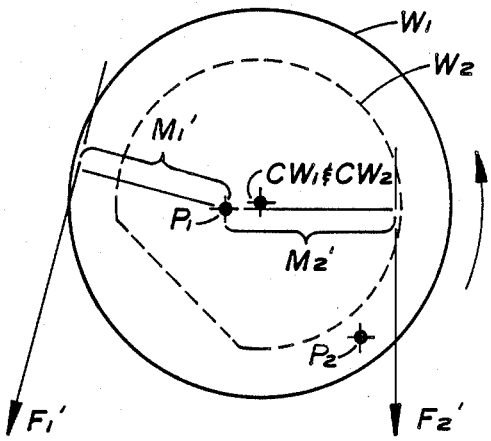
FIG. 17 is a schematic diagram based on the second embodiment of the invention in the 50% drawn position as shown in FIG. 9.

FIG. 17 is a schematic diagram based on the second embodiment 128 in the 50% drawn position as shown in FIG. 9. $F_1'$ is the bowstring cable force in this position; $F_2'$ is the limb cable force in this position; $M_1'$ is the length of the moment arm of $F_1'$; and $M_2'$ is the length of the moment arm of $F_2'$.

Figure 18:
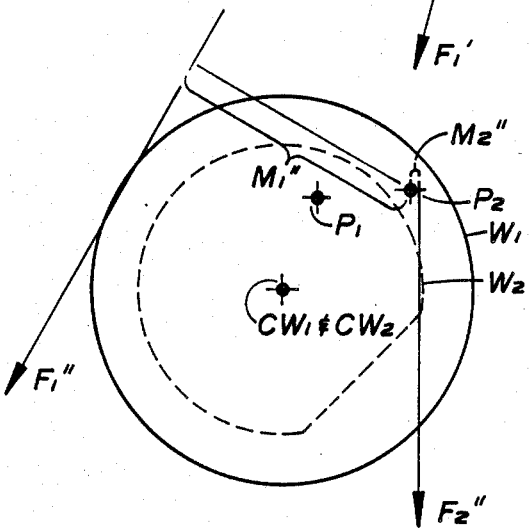
FIG. 18 is a schematic diagram based on the second embodiment of the invention in the full draw position as shown in FIG. 10.

FIG. 18 is a schematic based on the full draw position shown in FIG. 10. $F_1''$ is the bowstring cable force in this position; $F_2''$ is the limb cable force; $M_1''$ is the length of the moment arm of $F_1''$; and $M_2''$ is the length of the moment arm of $F_2''$. It should be noted that the fulcrum or the axis of the moment arms has transferred from $P_1$ to $P_2$ and that $M_1''$ is long compared to $M_2''$.

The above-described embodiments are intended to be illustrative, not restrictive. The full scope of the invention is defined by the claims, and any and all equivalents are intended to be embraced.

What is claimed is:

1. A moment transfer pulley system to be used on a compound archery bow, comprising:

(a) a compound pulley assembly, said pulley assembly comprising a limb cable wheel means and a bowstring cable wheel means which rotate as a unit and having means for being eccentrically mounted on a primary axle; and (b) means including a secondary axle by which said compound pulley assembly is displaced laterally of the primary axle upon the draw of the bowstring reaching substantially full draw whereby the fulcrum of the moment arms of the bowstring force and the limb cable force is transferred from the primary axle to the secondary axle.

2. In a compound archery bow pulley assembly comprising a limb cable wheel means and a bowstring wheel means which rotate as a unit and having means for being eccentrically mounted on a primary axle, the improvement which comprises a secondary axle by means of which the pulley assembly is displaced laterally of the primary axle and the pivot axis of the assembly is shifted from the primary axle to the secondary axle upon the bow string being drawn to substantially its fully drawn position, the bowstring moment arm thereby being increased and the force necessary to maintain the bowstring in fully drawn position being correspondingly reduced.

3. The compound archery bow pulley assembly of claim 2, wherein the pulley assembly includes cam means acting on said secondary axle as the wheel means are rotated responsive to bowstring draw, and slot means in which said secondary axle moves responsive to said cam means.

4. A compound archery bow comprising pulley assemblies according to claim 2 arranged at the ends of the limbs thereof.

5. A moment transfer pulley system to be used on a compound archery bow, comprising:

(a) a compound pulley assembly, said pulley assembly comprising a limb cable wheel means and a bowstring cable wheel means which rotate as a unit and having means for being eccentrically mounted on a transverse primary axle means and means for holding a transverse secondary axle means, said limb cable wheel means being adapted to carry a limb cable and said bowstring cable wheel means being adapted to carry a bowstring cable;

(b) two moment transfer cam means, each of said cam means being adapted to be mounted adjacent to a respective side of said compound pulley assembly, each of said cam means being further adapted to be held in fixed relationship to a limb of said compound bow, each of said moment transfer cam means having notch means in its outer periphery for receiving said secondary axle means; and (c) a secondary axle means, said secondary axle means being adapted to be held transversely in said compound pulley assembly and said secondary axle means being located so that when said compound pulley assembly is mounted on said primary axle means, and when said bow reaches the full draw position, then said secondary axle means is received into said notch means in the outer periphery of said moment transfer cams.

6. The moment transfer pulley system of claim 5 wherein said pulley assembly has multiple positions for said means for holding said secondary axle means whereby the location of said secondary axle means may be changed for different draw length settings.

7. The moment transfer pulley system of claim 5 wherein said moment transfer cam means have means for adjusting the angle between the plane of the side of said notch means and the plane of said limb cable whereby the amount of letoff at full draw may be adjusted.

8. The moment transfer pulley system of claim 5 wherein said moment transfer cam means are adapted to be mounted on said primary axle means.

9. The moment transfer pulley system of claim 5 wherein said compound pulley assembly has a cable passageway means and means for securing the cable therein to provide for different draw length settings.

10. The moment transfer pulley system of claim 5 wherein the draw force curve for said moment transfer pulley system, when mounted in a compound archery bow, is characterized by a smooth rapid rise in the early portion of the draw force curve which reaches a plateau that is maintained until the full draw point is reached and has a vertical drop at this point to a minimum level.

11. The moment transfer pulley system of claim 5 wherein a line drawn through the center point of said bowstring cable wheel means and the center point of said limb cable wheel means is perpendicular to a line drawn through the center point of the primary axle and the center point of the secondary axle.

12. The moment transfer pulley system of claim 5 wherein the center point of the primary axle means is located on a line that is at a 45° angle to a horizontal line drawn through the center point of said bowstring cable wheel means and wherein a ratio of 2.25 to 1 exists between the radius of said bowstring cable wheel means and the distance between the center point of said bowstring cable wheel means and the center point of the primary axle means.

13. The moment transfer pulley system of claim 5 wherein said compound pulley assembly has means for being mounted eccentrically on a transverse primary axle means which comprises:

(a) a first transverse slot means in said compound pulley assembly, said first slot means being in the shape of a French curve;

(b) a transverse sleeve means adapted to receive said primary axle, said sleeve means being located in said first slot means;

(c) support means connected to said sleeve means to hold said sleeve means in fixed relation to a transverse axle means mounting a pinion gear means;

(d) a second transverse slot means in said compound pulley assembly, said second slot means being rectangular in shape;

(e) a transverse axle means mounting a pinion gear means, said axle means being located in said second slot means; and (f) a toothed rack means mounted on said pulley assembly, said rack means being in meshing engagement with said pinion gear means.

14. A compound archery bow having two moment transfer pulley systems, said compound bow comprising:

(a) a central handle portion for gripping the bow;

(b) a pair of limbs extending outwardly from the opposite ends of said handle portion, said limbs having inner end portions connected with said handle portion and also having free outer end portions;

(c) cable means for flexing said pair of limbs;

(d) moment transfer pulley system means for supporting said cable means on said limbs, said moment transfer pulley system means including a compound pulley assembly mounted eccentrically on a primary axle means;

(e) primary axle means mounted on the outer end portion of each of said limbs for rotatably mounting said compound pulley assemblies on said limbs; and (f) each of said moment transfer pulley system means including:

(i) a compound pulley assembly, said pulley assembly comprising a limb cable wheel means and a bowstring cable wheel means, which rotate as a unit and having means for receiving said transverse primary axle means and means for holding a transverse secondary axle means, said limb cable wheel means carrying a limb cable and said bowstring cable wheel means carrying a bowstring cable;

(ii) two moment transfer cam means, said cam means being mounted on said primary axle means adjacent to each side of said compound pulley assembly, said cam means being held in fixed relationship to a limb of said compound bow, each of said moment transfer cam means having a notch means in its outer periphery for receiving said secondary axle means; and (iii) a secondary axle means, said secondary axle means being mounted transversely in said compound pulley assembly, so that when said bow reaches the full draw position, then said secondary axle means is received into said notch means in the outer periphery of said moment transfer cams.

15. The compound bow defined in claim 14 wherein said compound pulley assembly has multiple positions for said means for holding said secondary axle means whereby the location of said secondary axle means may be changed for different draw length settings.

16. The compound bow defined in claim 14 wherein said moment transfer cam means have means for adjusting the angle between the plane of the side of said notch means and the plane of said limb cable whereby the amount of letoff at full draw may be adjusted.

17. The compound bow defined in claim 14 wherein said moment transfer cam means are adapted to be mounted on said primary axle means.

18. The compound bow defined in claim 14 wherein said compound pulley assembly has a cable passageway means and means for securing the cable therein to provide for different draw length settings.

19. The compound bow defined in claim 14 wherein the draw force curve for said bow is characterized by a smooth rapid rise in the early part of the draw force curve which reaches a plateau that is maintained until the full draw point is reached and has a vertical drop at this point to a minimum level.

20. The compound bow defined in claim 14 wherein said moment transfer pulley system is constructed so that a line drawn through the center point of said bowstring cable wheel means and the center point of said limb cable wheel means is perpendicular to a line drawn through the center point of the primary axle and the center point of the secondary axle.

21. The compound bow defined in claim 14 wherein said moment transfer pulley system is constructed so that the center point of the primary axle is located on a line that is at a 45° angle to a horizontal line drawn through the center point of said bowstring cable wheel means and wherein a ratio of 2.25 to 1 exists between the radius of said bowstring cable wheel means and the distance between the center point of said bowstring cable wheel means and the center point of the primary axle.

22. The compound bow defined in claim 14 wherein said compound pulley assembly has means for being mounted eccentrically on a transverse primary axle means which comprises:

(a) a first transverse slot means in said compound pulley assembly, said first slot means being in the shape of a French curve;

(b) a transverse sleeve means adapted to receive said primary axle, said sleeve means being located in said first slot means;

(c) support means connected to said sleeve means to hold said sleeve means in fixed relation to a transverse axle means mounting a pinion gear means;

(d) a second transverse slot means in said compound pulley assembly, said second slot means being rectangular in shape;

(e) a transverse axle means mounting a pinion gear means, said axle means being located in said second slot means; and (f) a toothed rack means mounted on said pulley assembly, said rack means being in meshing engagement with said pinion gear means.

23. A moment transfer pulley system to be used on a compound archery bow, comprising:

(a) a compound pulley assembly, said pulley assembly comprising a limb cable wheel means and a bowstring cable wheel means which rotate as a unit and having means for being mounted eccentrically on a transverse primary axle means, said limb cable wheel means being adapted to carry a limb cable and said bowstring cable wheel means being adapted to carry a bowstring cable;

(b) two moment transfer cam means, one of said cam means being mounted on the face of said limb cable wheel means and the other of said cam means being mounted on the face of said bowstring cable wheel means, each of said moment transfer cam means having a notch means in its inner periphery for receiving a secondary axle means; and (c) two secondary axle means, each of said secondary axle means being adapted to be transversely mounted in fixed relationship to a limb of said compound bow adjacent to one side of said compound pulley assembly, so that when said compound pulley assembly is mounted on said primary axle means and when said bow reaches the full draw position, then said secondary axle means are received into said notch means in the inner periphery of each of said moment transfer cams.

24. The moment transfer pulley system of claim 23 wherein said compound pulley assembly has a cable passageway means and means for securing the cable therein to provide for different draw length settings.

25. A compound archery bow comprising compound pulley assemblies eccentrically journalled thereon with limb cables and a bowstring interconnecting the limbs, said pulley assemblies each including a first axle means about which the pulleys rotate while the bowstring is being drawn and until it is nearly fully drawn, and said pulley assemblies each further including a second axle means laterally offset from said first axle means about which the pulleys rotate during further movement of the bowstring as it becomes fully drawn.

26. A compound archery bow according to claim 25, wherein rotation of the pulley about the first axle means occurs for about 90% of the draw length and occurs about the second axle means for the remaining about 10% of the draw length.

* * * * *